United States Patent [19]

Marz

[11] Patent Number: 4,492,165

[45] Date of Patent: Jan. 8, 1985

[54] EXPANDABLE EXPLOSIVE AND STEMMING CARTRIDGE

[75] Inventor: Horst F. Marz, Otterburn Park, Canada

[73] Assignee: C-I-L Inc., North York, Canada

[21] Appl. No.: 599,646

[22] Filed: Apr. 12, 1984

[30] Foreign Application Priority Data

Aug. 8, 1983 [CA] Canada ..... 434111

[51] Int. Cl.[3] ..... F42D 3/00

[52] U.S. Cl. ..... 102/313; 102/323; 102/324; 102/333

[58] Field of Search ..... 102/323, 324, 333, 312, 102/313

[56] References Cited

U.S. PATENT DOCUMENTS

| | | | |
|---|---|---|---|
| 1,220,208 | 3/1917 | Ellis | 102/323 X |
| 2,966,855 | 1/1961 | Barco | 102/323 X |
| 3,087,425 | 4/1963 | Griffith | 102/323 X |
| 3,122,096 | 2/1964 | Wick | 102/323 X |
| 3,323,455 | 6/1967 | Griffith | 102/323 X |
| 3,783,787 | 1/1974 | Thornley et al. | 102/324 X |
| 3,806,025 | 4/1974 | Marshall | 102/333 X |

*Primary Examiner*—Peter A. Nelson

*Attorney, Agent, or Firm*—Donald G. Ballantyne

[57] ABSTRACT

An explosive or stemming package is provided which is self-retaining in vertical or inclined up-holes in stable rock. The package containing a flowable material, for example, slurry explosives, consists of a thin-walled cylindrical bag having at least one longitudinal, external pleat held closed by means of an adhered overcovering or tape. With the package held in position in the up-hole by a push rod, the tape is severed by means of a rip cord allowing the pleat to open. The slumping contents press the package closely against the borehole wall for secure retention without additional support. Improved coupling of the explosive charge to the rock is also provided giving enhanced blasting efficiency.

1 Claim, 4 Drawing Figures

EXPANDABLE EXPLOSIVE AND STEMMING CARTRIDGE

The present invention relates to containers or packages of flowable explosives or stemming material. In particular, the invention is concerned with a container adapted for use in relatively large diameter boreholes drilled vertically or inclined into the ceiling of an underground chamber.

Modern mining procedures now permit the excavation of large underground chambers in stable ore bodies. These procedures make use of relatively large diameter boreholes, up to 15 cm. in diameter or larger, and frequently these boreholes are drilled upward vertically into the ceiling of the chamber to depths (lengths) of 30 meters or longer. The placing of cylindrical packaged explosive charges into these vertical boreholes has been accomplished only with difficulty since a typical 15 cm. diameter explosive container may weigh up to 36 kilograms or more. In the procedure normally employed, a cylindrical explosive container is fitted into the mouth of the vertical borehole and manually pushed upward into the borehole using a coupled wooden or plastic push rod. A locking device adapted to grip the borehole wall may be located below the explosive container to retain it in the borehole. A subsequent explosive container or containers plus containers of stemming material are similarly loaded into the borehole. Retaining conventional explosive cartridges or containers in upward or inclined boreboles presents problems which are magnified when large diameter charges are employed since the containers have little or no tendency to cling to the walls of the borehole and their great weight acts to cause them to slip downward. One method of overcoming this problem is proposed by Rolfes in British Pat. No. 800,676 where the use of a wall gripping structure attachable to the rear end of a cartridge is disclosed. Such a device, however, is limited to use with relatively small diameter, lightweight cartridges since its gripping force is not great enough to retain large diameter, heavy containers. Furthermore, since in the practice of the usual method a cartridge smaller than the borehole is required, only poor coupling between the explosive charge and the borehole wall is achieved which frequently results in poor blasting efficiency.

It has now been found that packaged, large diameter charges of flowable explosives and stemming materials may be retained in inclined or vertical ceiling boreholes in stable rock by employing a container which comprises an elongated, flexible, thin-walled tube closed at each end and containing flowable material, said tubular container having at least one end-to-end longitudinal pleat therein, said pleat being sealed along the external surface of said container to form a cylindrical structure marginally smaller in diameter than said borehole, said pleat seal being adapted to sever within the borehole to allow said container to expand laterally, due to the weight and pressure of the contents of the container, and to grip the walls of said borehole.

In another embodiment of the invention, a longitudinally pleated, end-sealed, inner container containing flowable material is retained within a surrounding end-sealed outer container having at least one end-to-end longitudinal pleat or joint, said pleat or joint being sealed along its length so as to form a cylindrical structure, said sealed pleat or joint adapted for opening in a borehole to allow the said inner and outer bags to expand, due to the head pressure of the contents of the inner container, to grip the walls of the borehole.

The invention will be more readily understood by reference to the accompanying drawings wherein.

Figure 1:
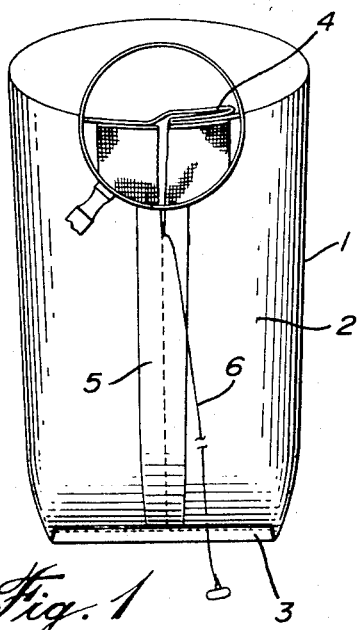
FIG. 1 is a perspective cut-away view of an unfilled explosive or stemming container of the invention.

With reference to FIG. 1, 1 designates a cylindrical tubular container, the top portion of which has been cut away to provide an internal view. Container 1 comprises a tube 2 of, for example, a flexible, thin-walled film, such as of a polyolefin, PVC, polyester or the like. The end 3 of tube 2 is closed as, for example, by heat sealing or stitching. Tube 2 also comprises an inward fold or pleat 4, which pleat is held closed by means of an external sealing strip 5 which may be, for example, a length of pressure sensitive or stitched-on tape. Sealing strip 5 is adapted to be severed or torn longitudinally by means of a rip cord 6 which is attached to the end 3 of the tube and is embedded in the underside of sealing strip 5. Flowable explosives or stemming material is filled into the pleated and sealed tube 2 through the top opening which is, thereafter, sealed closed.

Figure 2:
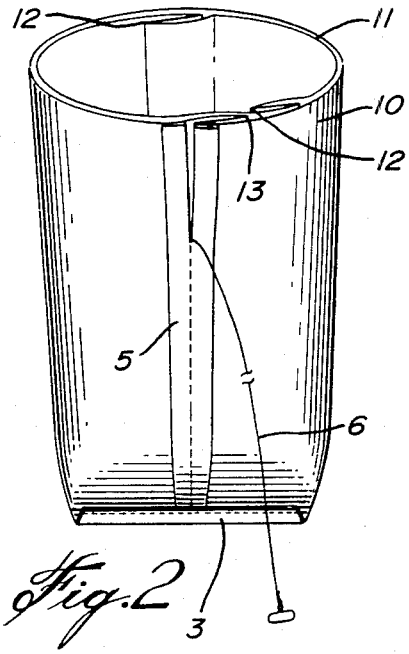
FIG. 2 is a perspective, cut-away view of a second embodiment of an unfilled container of the invention.
Figure 3:
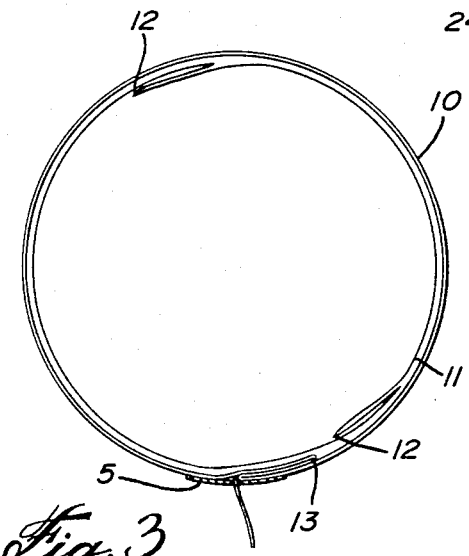
FIG. 3 is a section along the lines A—A of FIG. 2.

With reference to FIGS. 2 and 3, there is shown a double wall container with the top portion cut away to provide an internal view comprising an outer tube 10 and an inner tube 11. The construction of outer tube 10 is identical to that of the container of FIG. 1 described above and contains an inward pleat 13. Inner tube 11 comprises a sheath or tube of thin-walled, flexible plastic closed at its bottom end (not shown) within outer tube 10. Tube 11 comprises one or more longitudinal, inward folds or pleats 12 which are pressed against the inner wall of tube 10 (FIG. 3) when flowable material is filled into tube 11 through the top opening. As in FIG. 1, sealing strip 5 and rip cord 6 are provided which allow outer tube 10 to be expanded laterally along pleat 13 when strip 5 is torn or severed by the cutting action of cord 6 and its flowable content slumps. Outer tube 10 can conveniently be made from a woven plastic cloth, for example, woven polypropylene.

Figure 4:
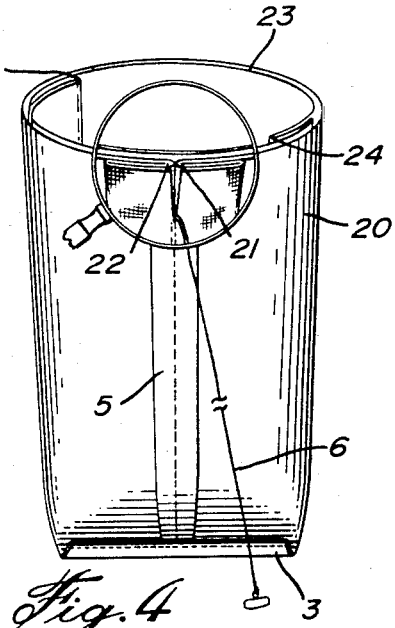
FIG. 4 shows an alternate construction of the container of FIG. 2.

With reference to FIG. 4, there is shown an inner and outer tube package similar to that of FIG. 2 except that no pleat is employed in outer tube 20. Tube 20 is formed by butt-joining or slightly overlapping edges 21 and 22 of the film comprising tube 20. The butted or overlapped joint 21–22 is held together with sealing strip 5. Inner tube 23 within tube 20 is shown with two pleats or folds 24. When sealing strip 5 is severed by means of rip cord 6, joint 21–22 opens, thus allowing inner tube 23 to expand laterally as its fluid content slumps.

In use in the field, a cylindrical package, as shown in FIG. 1 and containing a flowable material, is chosen having an outside diameter slightly less than the diameter of the receiving borehole. The rip cord 6 is sufficiently long to extend the length of the borehole. The package is pushed upward into the borehole by means of a push rod to the desired location in the borehole where it is held while the sealing strip 5 is severed by pulling on the rip cord 6. As strip 5 is separated, the flowable content within the container 1 slumps and pushes against pleat 4 causing the container to expand to fill the borehole. The friction force of outer tube 2 against the borehole wall is sufficient to "hold up" the package when the elevating push rod is removed. Packages having the embodiment shown in FIGS. 2 and 4 are loaded into the borehole in a similar fashion. Upon the severing of sealing strip 5, by means of rip cord 6, the outer tubes 10 (FIG. 2) and 20 (FIG. 4) open to the diameter of the borehole allowing inner tubes 11 (FIG. 2) and 23 (FIG. 4) to expand due to the slumping of the flowable content and thus "hold up" in the borehole. Furthermore, the slumped explosive charge is closely coupled to the wall of the borehole resulting in maximum utilization of the explosive energy upon detonation of the charge.

It will be appreciated that the expanding container of the invention will have utility for the intended purpose only if the contents are sufficiently flowable to slump and to expand the pleated container to provide close contact with the borehole walls.

It has been found that the expanded container will always be retained in the borehole when the frictional forces between container and borehole wall are greater than the weight of the container. Thus, it is critical that the container chosen be long enough to provide adequate frictional contact with the borehole wall. In some cases, this will require the use of containers which are longer than those of conventional cartridged explosives. The ability of the expanded container to "hold up" in a vertical borehole is dependent upon the friction coefficient $\mu$ between borehole wall and container, the borehole diameter D and the slumped explosives length h. This relationship is expressed by the formula:

$$1/2\, h^2 D\gamma\mu\pi > D^2 \frac{\pi}{4} h\gamma$$

where $\gamma$=density of the explosive.

This formula may be reduced:

$$\mu > 1/2 \frac{D}{h}$$

It has been determined by measurement that the friction coefficient between stable borehole rock and polyethylene film container material ranges from 0.1–0.2 with an average of about 0.15. Assuming a friction coefficient of 0.15 and a borehole diameter D of 16.5 cm., the suitable "slumped" container length h made from polyethylene film, can be calculated, thus, $$h_{min} = \frac{D}{2 \times \mu} = \frac{16.5}{2 \times 0.15} = 55 \text{ cm.}$$

Thus, a "hold up" container for a 16.5 cm. diameter borehole must have a slumping length of at least 55 cm.

EXAMPLE

In an underground chamber of a metal ore mine, a series of 22 up-holes each having a diameter of 16.5 cm. were drilled to depths varying from 6–10 meters into the ceiling of the chamber. Containers having an outside diameter of 14 cm. identical to those depicted in FIG. 2 of the drawing and containing 34 Kg. of a flowable slurry explosive mixture, were elevated by push rod to a position near the end of each borehole. The explosive containers were each armed by means of a cast primer charge and a non-electric blasting cap and NONEL (Reg. TM) shock tube. Once in position, the pleated outer container was opened when the overcovering tape was severed by means of the extending rip cord. The container was held up in the borehole when the contents slumped to expand the inner bag. A similar container of flowable sand stemming material was placed in the borehole below the explosive charge in a like manner. The process was repeated with another explosive container and a stemming container to provide a decked blasting configuration in each borehole. When all boreholes were loaded, the explosives were detonated with excellent blasting results.

I claim:

1. A method of charging an upward or inclined vertical borehole in stable rock with packaged flowable explosive or stemming material using as a container for the said explosive or stemming material an elongated, flexible, thin-walled tube closed at each end and having at least one end-to-end longitudinal pleat, said pleat being sealed closed by means of an adhered, severable overcovering, the said overcovering having a fastened to it a ripcord extending beyond the borehole opening to longitudinally sever said overcovering, said method comprising elevating said container to a chosen position within the said vertical borehole and while in said chosen position operating the said ripcord to sever the said overcovering to allow said pleat to expand from the head pressure of the contained material so that said container engages and is retained by the walls of said borehole and is prevented from falling from the borehole by the frictional contact between the said container and the said borehole wall.

* * * * *